US006470919B1

(12) United States Patent
Wardle

(10) Patent No.: US 6,470,919 B1
(45) Date of Patent: Oct. 29, 2002

(54) MOTIVE DRIVE FOR WARP SELECTION

(75) Inventor: Mike Wardle, County Durham (GB)

(73) Assignee: Bonas Machine Company Limited, Tyne & Wear (GB)

( * ) Notice: Subject to any disclaimer, the term of this patent is extended or adjusted under 35 U.S.C. 154(b) by 0 days.

(21) Appl. No.: 09/787,018

(22) PCT Filed: Sep. 17, 1999

(86) PCT No.: PCT/GB99/03104

§ 371 (c)(1),
(2), (4) Date: Mar. 13, 2001

(87) PCT Pub. No.: WO00/17431

PCT Pub. Date: Mar. 30, 2000

(30) Foreign Application Priority Data

Sep. 18, 1998 (GB) ..... 9820314

(51) Int. Cl.[7] ..... D03C 13/00

(52) U.S. Cl. ..... 139/455; 310/311; 139/319; 139/55.1

(58) Field of Search ..... 310/311; 139/455, 139/319, 55.1

(56) References Cited

U.S. PATENT DOCUMENTS 5,070,913 A * 12/1991 Palmer ..... 139/455
5,416,375 A 5/1995 Funakubo
5,464,046 A * 11/1995 McIntyre et al. ..... 139/455
5,834,879 A * 11/1998 Watanabe et al. ..... 310/328
6,041,831 A * 3/2000 Kuoni et al. ..... 139/455

FOREIGN PATENT DOCUMENTS

| | | |
|---|---|---|
| EP | 0353005 | 1/1990 |
| EP | 0668381 | 8/1995 |
| EP | 0795635 | 9/1997 |
| FR | 2680526 | 2/1993 |
| WO | 9733024 | 9/1997 |
| WO | 98 07200 | 2/1998 |

* cited by examiner

*Primary Examiner*—A. Vanatta
*Assistant Examiner*—Robert H. Muromoto, Jr.
(74) *Attorney, Agent, or Firm*—Dann, Dorfman, Herrell and Skillman, P.C.; Henry H. Skillman

(57) ABSTRACT

A motive assembly for moving a plurality of warp yarns (32) in a loom between upper and lower shed positions, the motive assembly including a plurality of selectively controllable ultrasonic cyclic motors (10), each of which is drivingly connected to one or a group of said warp yarns (32) for moving the warp yarn(s) (32) between upper and lower shed positions.

15 Claims, 5 Drawing Sheets

MOTIVE DRIVE FOR WARP SELECTION

FIELD OF THE INVENTION

The present invention relates to a motive assembly for selectively controlling shedding of warp threads in a loom.

SUMMARY OF THE INVENTION

According to a general aspect of the present invention there is provided a motive assembly for moving a plurality of warp yarns in a loom between upper and lower shed positions, the motive assembly including a plurality of selectively controllable ultrasonic cyclic motors, each of which is drivingly connected to one or a group of said warp yarns for moving the warp yarn(s) between upper and lower shed positions.

Preferably the ultrasonic cyclic motor is a piezo motor, preferably operating at a frequency of between 20–40 KHz.

The motor may be drivingly connected to the warp yarn by a rigid elongate heald rod which is driven by the motor. The motor may directly contact the elongate heald rod in order to displace it longitudinally. Alternatively, the motor may drive the heald rod indirectly via a transmission means such as a drive gear or wheel.

DESCRIPTION OF THE DRAWINGS

Various aspects of the present invention are hereinafter described with reference to the accompanying drawings, in which.

DESCRIPTION OF THE PREFERRED EMBODIMENTS

Figure 8:
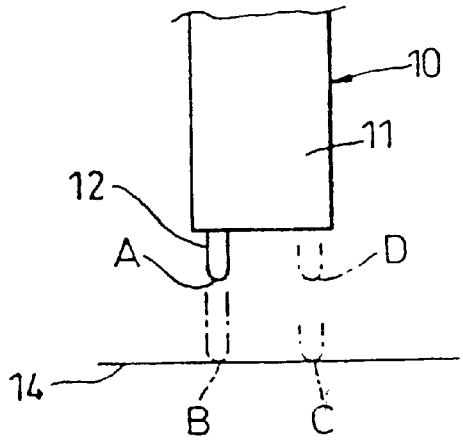
FIG. 8 is a schematic diagram illustrating the principle of operation of an ultrasonic motor as used in the present invention.

Referring initially to FIG. 8, there is shown an ultrasonic motor 10 including a casing 11 which houses a drive finger 12. The drive finger 12 is arranged to cyclically move along a cyclic path from a retracted position A (as shown) to an extended position B (shown in broken lines) and then whilst in its extended position, to the position C and then retracted to position D and then whilst in its retracted position, to position A.

The finger 12 is driven at high speed through the cycle of positions A,B,C and D, preferably by piezo-electric elements (not shown) housed within the casing 11.

The direction of movement through the cycle may be A to B to C to D or may be reversed, viz A to D to C to B depending upon the applied electrical current.

By placing a member 14 to be driven in the path of the finger 12 whilst it moves between positions B to C (or vice versa), it is possible for the finger 12 to drive, in a stepwise manner, the member 14 in the same direction of travel.

This type of motor operates at high speeds, typically at cycles of between 20 to 140 KHz. The motor typically has a cross-sectional dimension of about 8 mm×4 mm and a length of about 25 mm.

Figure 1:
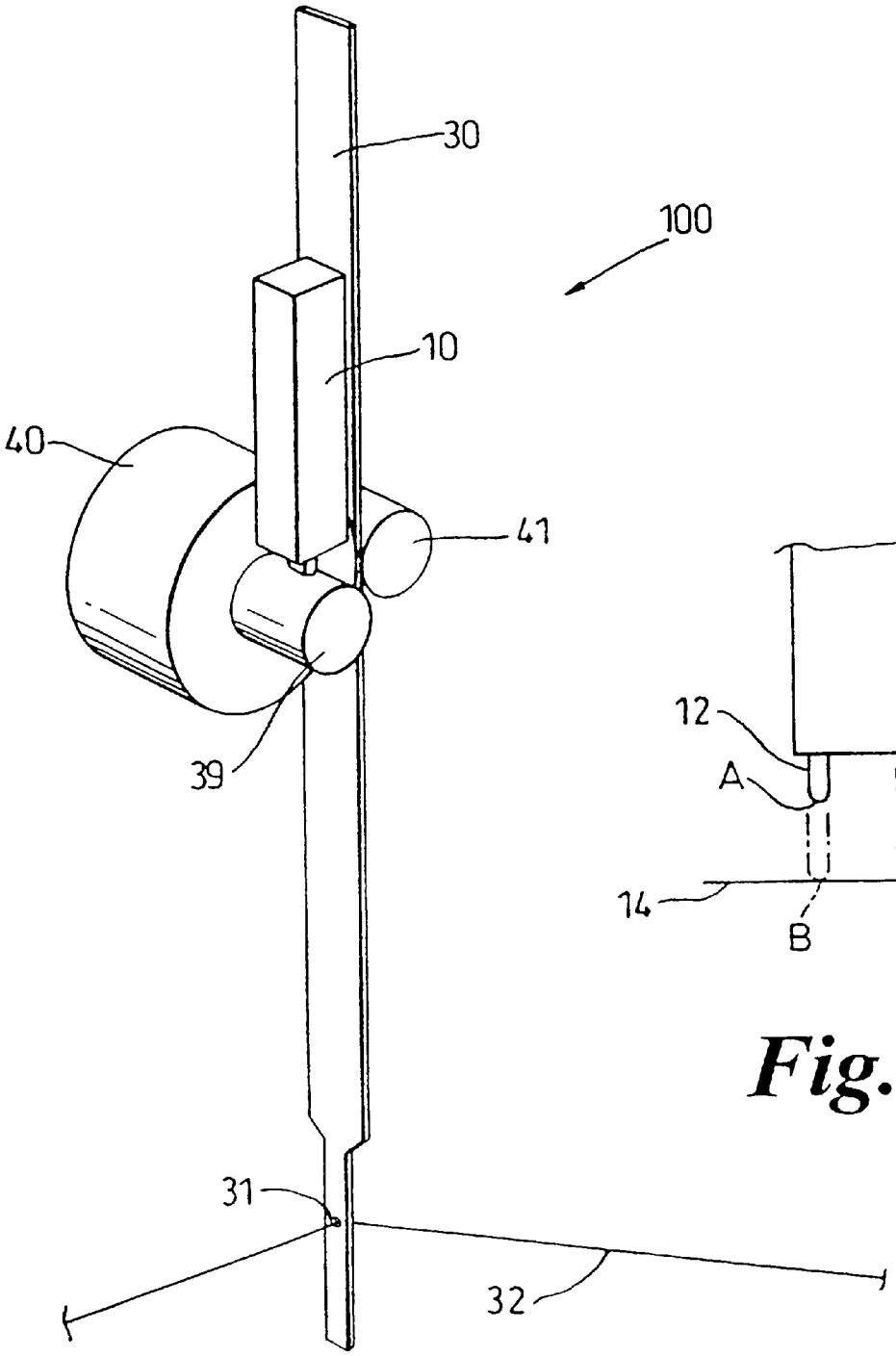
FIG. 1 is a schematic perspective view of a first embodiment according to the present invention.
Figure 2:
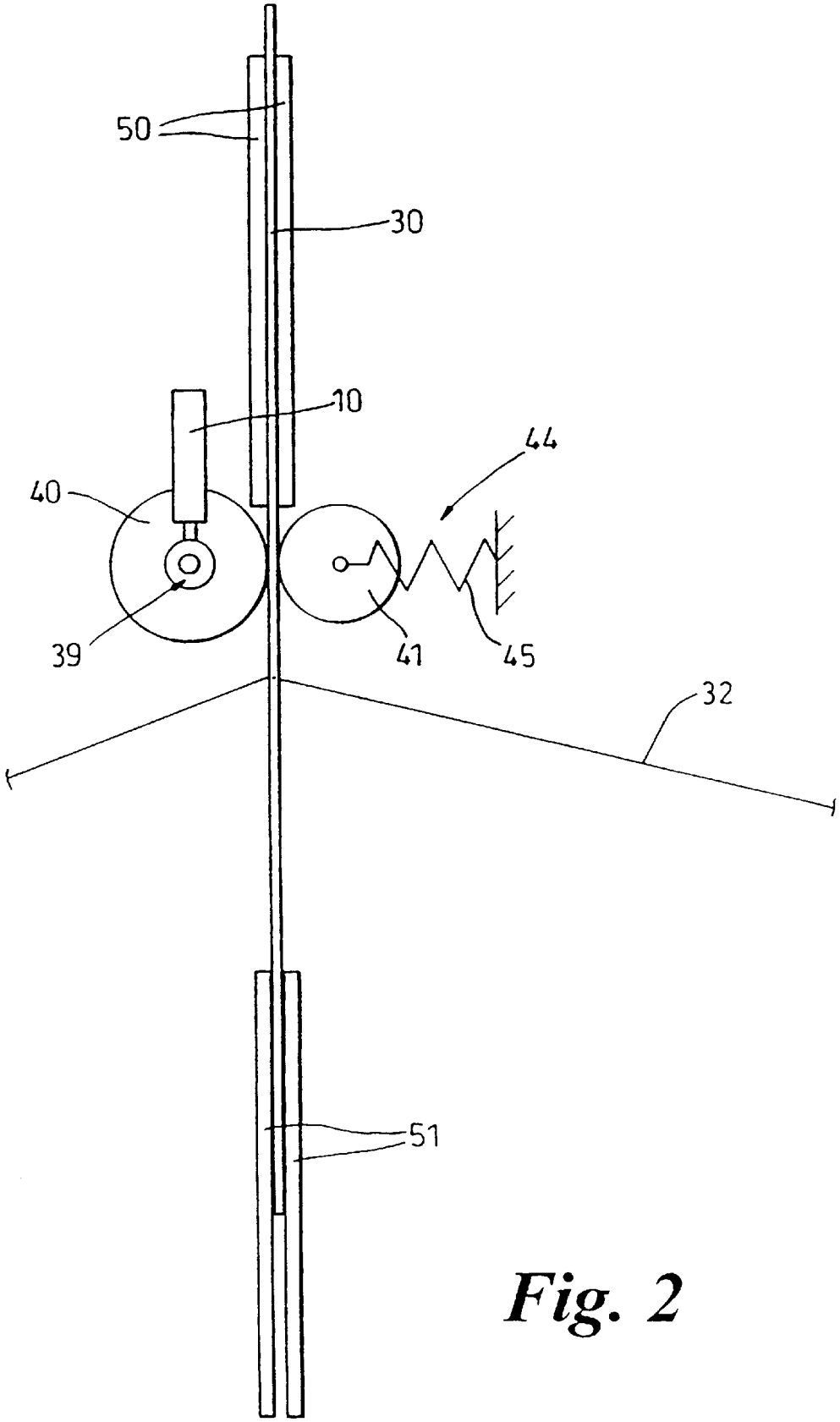
FIG. 2 is a side view of the first embodiment showing additional detail.

A first embodiment of the invention is illustrated in FIGS. 1 and 2.

In this embodiment, a rigid and elongate rigid heald rod 30 is directly connected to a heald eye 31 through which a single warp yarn 32 passes.

A drive wheel 40 having a frictional surface for frictionally driving the heald rod 30 is provided for movement of the heald rod 30. The drive wheel 40 is rotated by a motor 10 driving a shaft 39 upon which wheel 40 is fixedly mounted. A reaction roller 41 is resiliently urged towards wheel 40 to maintain frictional contact between the wheel 40 and heald rod 30.

The roller 41 is resiliently urged by biasing means 44 which may be a spring 45 or other compression material. If desired, the roller 41 may be replaced by a static member, such as a ceramic plate, which makes sliding contact with the heald rod 30. The heald rods move a plurality of warp yarns in a loom between upper and lower shed positions singly or in groups.

Preferably, as shown in FIG. 2, upper and lower guides 50,51 are provided for guiding longitudinal movement of the heald rod 30. The guides 50, 51 not only positively define the longitudinal path of movement of the heald rods but also provide support against lateral flexure of the rod. Such support enables relatively thin heald rods 30 to be used.

Preferably, sensing means (not shown) are provided for cooperation with the heald rod 30 in order to sense the longitudinal position of the heald rod 30 in order to determine when it has reached its upper and/or lower shed position.

Preferably when the heald rod 30 is at its upper or lower shed position, the motor 10 is de-activated with the finger 12 in its extended position. This enables the finger 12 to act as a brake to restrain movement of the heald rod 30.

Figure 3:
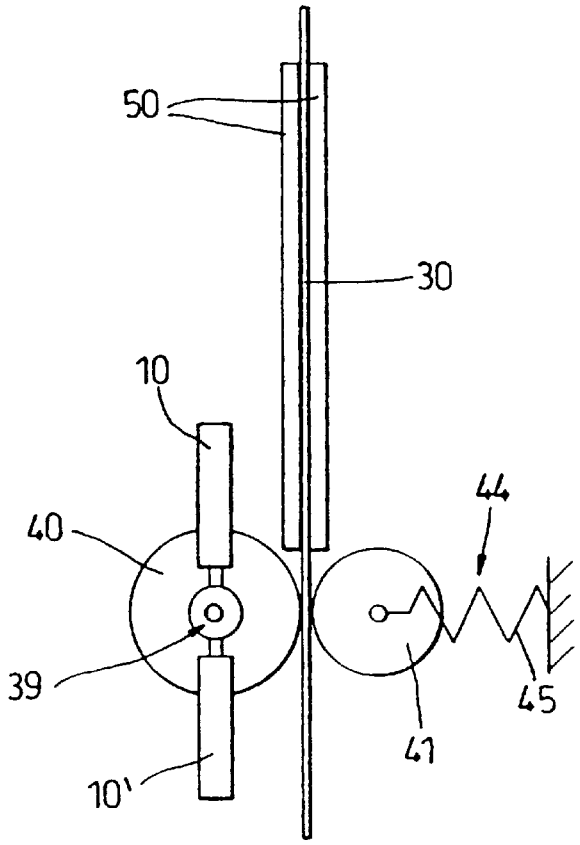
FIG. 3 is a side view similar to FIG. 2 showing a modification to the first embodiment.

In FIG. 3 there is provided a modification to the arrangement shown in FIGS. 1 and 2 wherein an additional motor 10' is provided for driving shaft 39.

Preferably, as seen in FIGS. 1 to 3, the motors 10,10' are arranged to extend in the direction of movement of the heald rod 30. This enables a compact arrangement to be achieved and helps to achieve a high density of warp yarns.

Figure 4:
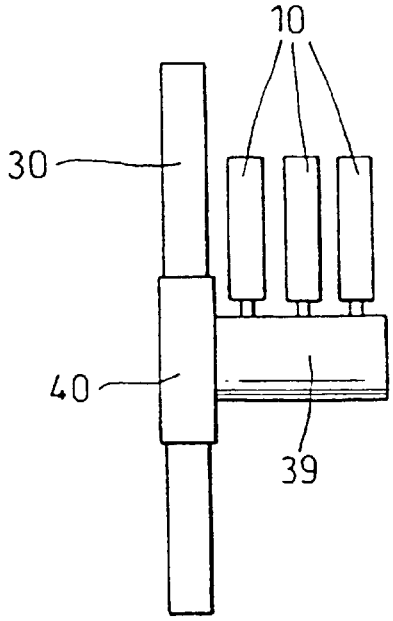
FIG. 4 is an end view of a second embodiment according to the present invention.

A further modification is shown in FIG. 4 wherein more than one motor 10 is arranged along the shaft 39. This modification applies to the arrangements shown in both FIGS. 1 and 3.

Figure 5:
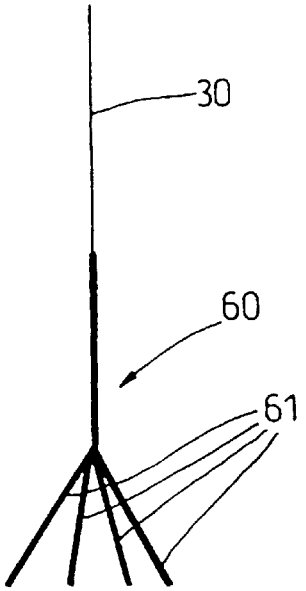
FIG. 5 is a view of the assembly showing a heald rod connected to a harness.

In FIG. 5, the heald rod 30 is shown as being connected to a harness 60 of flexible cords 61. This enables a single heald rod 30 to control movement of a group of warp yarns.

Figure 6:
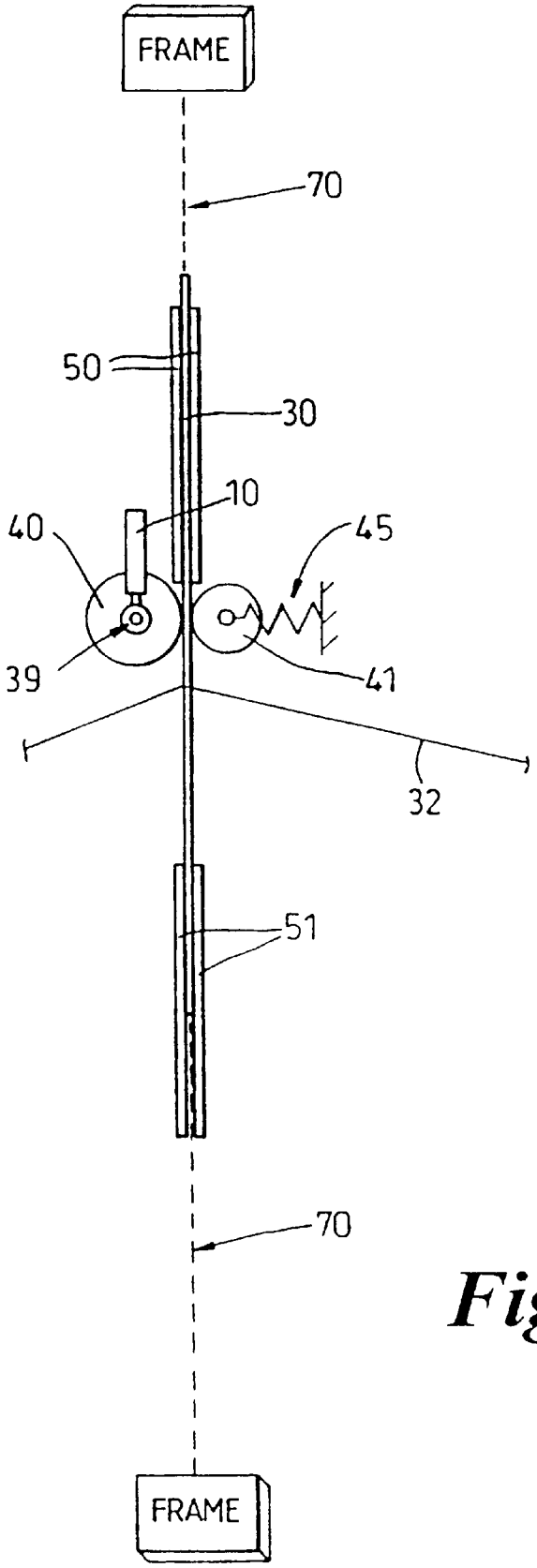
FIG. 6 is a side view of a third embodiment according to the present invention.

A further modification to the arrangements shown in FIGS. 1,3 and 4 is illustrated in FIG. 6 wherein biasing means 70, for example in the form of a spring or an elastic cord, such as Lycra, is provided for applying tensile forces to the heald rod 30.

Figure 7:
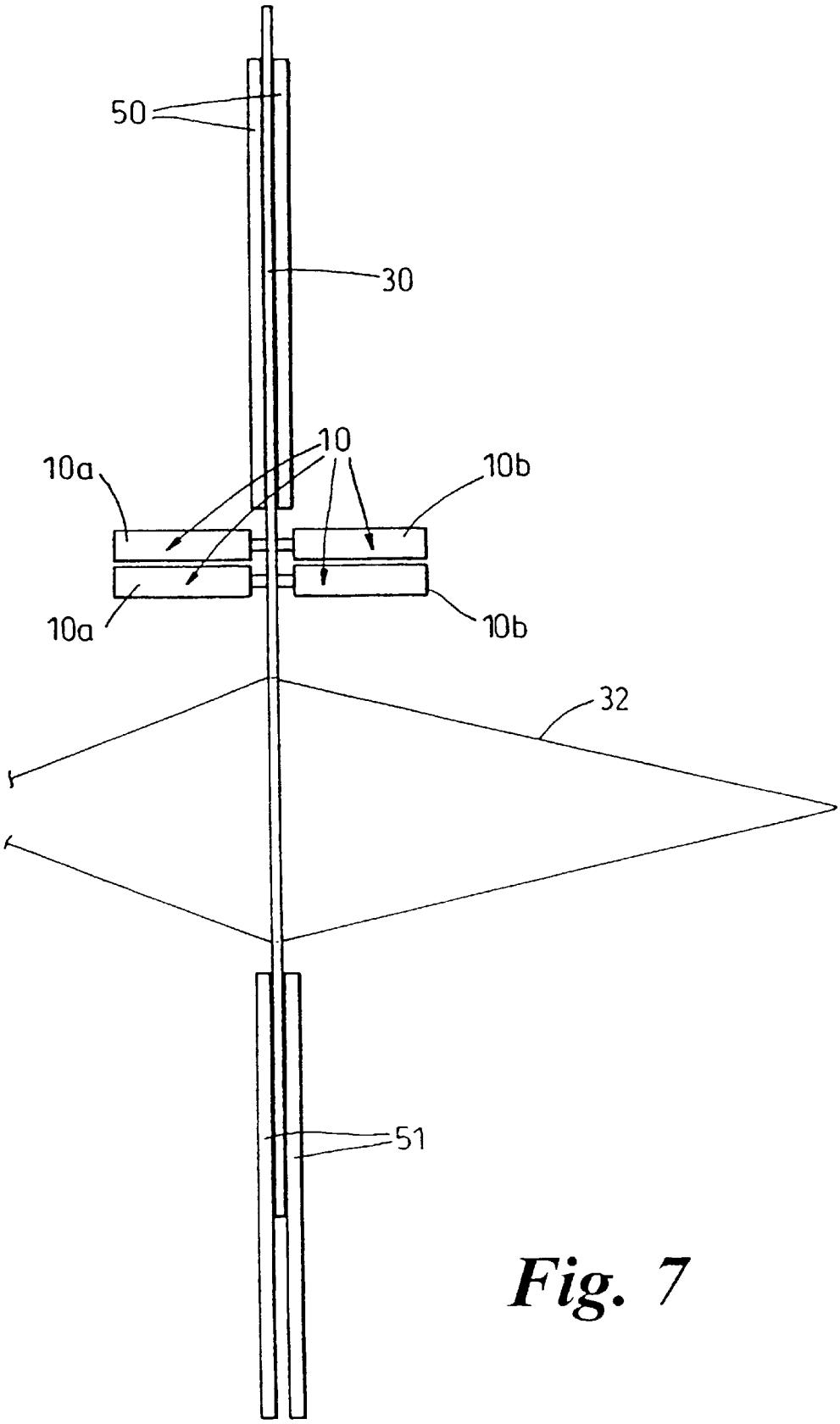
FIG. 7 is a side view of a fourth embodiment according to the present invention.

A further embodiment 200 is illustrated in FIG. 7 wherein motors 10 are arranged to directly drive the heald rod 30 by the fingers 12 actually making contact therewith.

Preferably at least a pair of opposed motors 10*a* and 10*b* are provided operating on opposite sides of the heald rod 30.

As illustrated two pairs of motors are provided. However, it will be appreciated that one or more motors 10 may be positioned to one side only of the heald rod 30 and that a reaction member be located on the other side.

It will be appreciated that the heald rods and motors 10 may be directly incorporated into a loom or may be incorporated into a separate jacquard machine for being situated or mounted on a loom.

It will be noted the shaft 39 and wheel 40 are of different diameter and so the peripheral speed of the wheel is higher than that of the shaft 39. Typically the ratio is 1:3.

However, it will be appreciated that the wheel 40 may have the same or smaller diameter than the shaft 39.

What is claimed is:

1. A motive assembly for moving a plurality of warp yarns in a loom between upper and lower shed positions, the motive assembly including a plurality of selectively controllable ultrasonic cyclic motors, each of which is drivingly connected to at least one of said warp yarns for moving said at least one warp yarn between upper and lower shed positions, and a rigid elongate heald rod connected to each of said warp yarns, each heald rod being associated with and driven by at least one of said ultrasonic motors.

2. An assembly according to claim 1 wherein each motor includes a drive output comprising a drive finger and means to drive said finger cyclically along a cyclic path.

3. An assembly according to claim 1 wherein each of said ultrasonic motors directly contacts its associated elongate heald rod in order to displace it longitudinally.

4. An assembly according to claim 3 wherein there is a group of said ultrasonic motors for each heald rod, a number of the ultrasonic motors of said group being arranged to contact one side of the heald rod and the remainder of the ultrasonic motors of said group being arranged to contact the opposite side of the heald rod.

5. An assembly according to claim 1 including a plurality of transmission means, wherein each of said ultrasonic motors indirectly drives its associated heald rod via one of said transmission means.

6. An assembly according to claim 5 wherein each of said transmission means includes a drive wheel or gear which drivingly contacts the associated heald rod such that rotation of the wheel or gear causes longitudinal movement of the associated heald rod.

7. An assembly according to claim 1 wherein each heald rod includes a heald eye to enable the heald rod to be connected to a warp yarn.

8. An assembly according to claim 2 wherein said drive means is operable at a frequency in the range of 20 to 140 KHz.

9. An assembly according to claim 3 including a reaction member for each of said ultrasonic motors, each of said motors being arranged to contact one side of its associated heald rod, and said reaction member being arranged to contact the opposite side of its associated heald rod.

10. An assembly according to claim 9 wherein said reaction member is resiliently urged towards toward its associated ultrasonic motor.

11. An assembly according to claim 5 including a reaction member for each of said transmission means, wherein said transmission means is arranged to contact one side of its associated heald rod and said reaction member is arranged to contact the opposite side of its associated heald rod.

12. An assembly according to claim 11 wherein said reaction member is resiliently urged towards toward its associated transmission means.

13. An assembly according to claim 2 wherein said cyclic path has a short step, and each heald rod is connected to its associated ultrasonic motor through friction drive to enable stepwise displacement of said heald rod a cumulative distance greater than said short step.

14. A jacquard machine for controlling a plurality of warp yarns in a loom including a motive assembly for moving a plurality of warp yarns between upper and lower shed positions, said motive assembly including a plurality of selectively controllable ultrasonic cyclic motors each of which is drivingly connected to at least one of said plurality of warp yarns for moving said at least one warp yarn between upper and lower shed positions and a rigid elongate heald rod connected to each of said warp yarns, each heald rod being associated with and driven by at least one of said ultrasonic motors.

15. A loom for weaving a plurality of warp yarns including a moving assembly for moving a plurality of warp yarns in a loom between upper and lower shed positions, the motive assembly including a plurality of selectively controllable ultrasonic cyclic motors, each of which is drivingly connected to at least one of said warp yarns for moving said at least one warp yarn between upper and lower shed positions and a rigid elongate heald rod connected to each of said warp yarns, each heald rod being associated with and driven by at least one of said ultrasonic motors.

* * * * *

UNITED STATES PATENT AND TRADEMARK OFFICE

CERTIFICATE OF CORRECTION

PATENT NO. : 6,470,919 B1
DATED : October 29, 2002
INVENTOR(S) : Wardle

It is certified that error appears in the above-identified patent and that said Letters Patent is hereby corrected as shown below:

Title page,
Item [54], Title, should read -- ULTRASONIC CYCLIC MOTIVE DRIVE FOR WRAP SELECTION --;

Column 1,
Line 19, "20-40 KHz" should be -- 20-140 KHz --;

Column 2,
Line 9, after "first embodiment" insert -- 100 --.

Signed and Sealed this

Eighteenth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,470,919 B1
DATED : October 29, 2002
INVENTOR(S) : Wardle

It is certified that error appears in the above-identified patent and that said Letters Patent is hereby corrected as shown below:

Title page,
Item [54], Title, should read -- ULTRASONIC CYCLIC MOTIVE DRIVE FOR WARP SELECTION --;

Column 1,
Line 19, "20-40 KHz" should be -- 20-140 KHz --;

Column 2,
Line 9, after "first embodiment" insert -- 100 --.

This certificate supersedes Certificate of Correction issued November 18, 2003.

Signed and Sealed this

Twenty-seventh Day of January, 2004

JON W. DUDAS
*Acting Director of the United States Patent and Trademark Office*